US005469696A

United States Patent [19]

Gerhard

[11] Patent Number: 5,469,696

[45] Date of Patent: Nov. 28, 1995

[54] PROCESS AND DEVICE TO DETERMINE THE DIAMETER OF A BOBBIN AT A SPINNING STATION OF A SPINNING MACHINE

[75] Inventor: Hoeber Gerhard, Ingolstadt, Germany

[73] Assignee: Rieter Ingolstadt Spinnereimaschinenbau AG, Ingolstadt, Germany

[21] Appl. No.: 345,552

[22] Filed: Nov. 28, 1994

Related U.S. Application Data

[63] Continuation of Ser. No. 64,136, filed as PCT/EP92/02466, Oct. 29, 1992, abandoned.

[30] Foreign Application Priority Data

Oct. 29, 1992 [WO] WIPO ..... 92/0466

[51] Int. Cl.[6] ..... D01H 13/24

[52] U.S. Cl. ..... 57/264

[58] Field of Search ..... 57/264, 265, 266

[56] References Cited

U.S. PATENT DOCUMENTS

| | | | |
|---|---|---|---|
| 3,877,209 | 4/1975 | Seidl et al. | 57/265 |
| 3,877,210 | 4/1975 | Seidl | 57/265 |
| 3,878,671 | 4/1975 | Seidl et al. | 57/265 |
| 3,988,879 | 11/1976 | Franzolini et al. . | |
| 4,019,310 | 4/1977 | Seidl et al. | 57/265 |
| 4,467,593 | 8/1984 | Araki | 57/264 X |
| 4,475,331 | 10/1984 | Promoli | 57/264 X |
| 4,723,720 | 2/1988 | Matsui et al. . | |
| 4,964,582 | 10/1990 | Hermanns et al. . | |
| 5,170,953 | 12/1992 | Stahlecker . | |

FOREIGN PATENT DOCUMENTS

| | | | |
|---|---|---|---|
| 452836 | 10/1991 | European Pat. Off. | 57/264 |
| 3826861 | 3/1989 | Germany | 57/264 |
| 3732966A1 | 4/1989 | Germany . | |
| 25727 | 2/1993 | Japan | 57/264 |
| 106121 | 4/1993 | Japan | 57/264 |

*Primary Examiner*—Joseph J. Hail, III
*Attorney, Agent, or Firm*—Dority & Manning

[57] ABSTRACT

The invention relates to a process to determine the diameter of a bobbin at a spinning station of a spinning machine processing fiber slivers as well as to a device to carry out this process. The object is to avoid listed disadvantages and to find the applicable diameter of a bobbin in a simple manner and without directly touching said bobbin.

21 Claims, 3 Drawing Sheets

64
65
24
53
23
52
25
26
44
95
76
70
42
73
72
71
70
74a
74b
74
7
SE1
SE2
SE3
Q1
P
Q2
SK1
SK2
SK3
KF1
KF2
KF3
SK-GL
KF-GL
SK-SD
S

PROCESS AND DEVICE TO DETERMINE THE DIAMETER OF A BOBBIN AT A SPINNING STATION OF A SPINNING MACHINE

This is a continuation of application Ser. No. 08/064,136, filed as PCT/EP92/02466, Oct. 29, 1992, which was abandoned upon the filing hereof.

BACKGROUND OF THE INVENTION

The instant invention relates to a process and device to determine the diameter of a bobbin at a spinning station of a spinning machine. A fiber sliver of known thickness is fed at a determined speed to the spinning stations of the spinning machine, is spun there into a yarn and is then drawn off at a draw-off speed which is at a defined ratio to the sliver feeding speed. The yarn is then wound up on the bobbin at a winding speed synchronized thereto.

In order to determine the diameter of the bobbin, a known method consists in providing a stop that is variable in relation to the bobbin surface. The variable stop is a mechanical measure to determine the changing bobbin diameter at desired points in time. In this connection, continuous or discontinuous mechanical sensors which touch the bobbin surface are normally used.

As has been shown in practice, it is a condition for precise operation that constantly hard wound yarn bobbins be produced. With slightly wound bobbins the above-mentioned measuring device has the disadvantage that the signal to be formed for the bobbin diameter is distorted by the compression of the bobbin surface by the variable stop. This situation leads to lack of precision which reduces the probability of success in grasping a yarn end following a yarn breakage or else affects the precision of bobbin replacement. Mechanical scanning of the bobbin diameter by means of scanners (DE-OS 38 27 345) does not remove the enumerated disadvantages of the state of the art.

By using non-contact sensors, another method to determine the diameter of the yarn bobbin was found. An optical sensor continuously ascertains the changing diameter of the bobbin without having to come into contact with the bobbin surface. Optical scanning (DE-OPS 36 17 151, FIG. 3) has however the disadvantage that the optics on the textile machine can become dirty from dust, fibers and other particles, having as a consequence a distortion of the obtained signal.

A third possibility (U.S. Pat. No. 3,877,209) according to the state of the art consists in determining the rotational speed of the draw-off or winding roller, on basis of which the yarn length and thereby the diameter of the yarn body are determined.

This solution could not be used, in particular for the positioning of a yarn take-up device in relation to a bobbin surface, since influence factors found in practice distort the constant formation of gaps between the surface of the yarn body and the yarn take-up device and are not taken into consideration. These influence factors also lead to imprecision in finding the point in time at which bobbin replacement is to be initiated.

Such influence factors include:

possibly run-in pressure rollers of varying hardness, causing slip at the draw-off rollers;

irregular wear of the slaving rubber on the friction rollers, causing variations in winding tension.

Because of the variety of materials capable of being spun as well as different production parameters (yarn thickness, winding tension) differences in yarn thickness and winding hardness are common, and these tend to render sensor-less determination of bobbin diameter as a guiding magnitude for control less precise than the utilization of sensors which actually measure the diameter.

OBJECTS AND SUMMARY OF THE INVENTION

It is a principal object of the instant invention to create a process and a device which avoid the disadvantages of the state of the art and make it possible to determine the diameter of the bobbin at any time in a simple manner, without direct scanning of the bobbin. Additional objects and advantages of the invention will be set forth in part in the description which follows, will be obvious from the description, of may be learned by practice of the invention.

The objects are attained by the invention in that the yarn thickness corresponding to a given bobbin diameter is determined empirically under predetermined conditions (yarn thickness, winding tension). The length of yarn produced at the spinning station is measured while taking into account possible interruptions of production. The yarn thickness is calculated from the product of sliver thickness and the ratios of sliver feeding speed and yarn draw-off speed. A characteristic magnitude for the winding hardness of the bobbin is calculated from the ratios of winding speed and draw-off speed. The found yarn thickness and the winding tension corresponding to the found winding hardness is compared with the yarn thickness and the winding tension on which the empirical determination of yarn length for a given bobbin diameter was based and in that deviations that may appear are used as a correction factor for yarn length in determining the actual bobbin diameter. The empirical determination of the yarn length is used to create a reference value. For this, the yarn length during the production of a bobbin can be measured through direct scanning of the yarn being fed to the bobbin. Of course it is also possible to unwind the yarn from a bobbin after it has been produced, i.e. once it has reached its desired size, and to measure it in an appropriate manner normally used for this.

The objective is now to produce the same yarn length during production, since it produces an identical bobbin size, unless some influences leading to deviations must be taken into consideration. Care must be taken here to take into consideration possible interruptions of production, such as the repair of yarn breakage, when determining the yarn length. For this reason the yarn length produced is measured, e.g. by measuring the revolutions of a draw-off roller while taking into consideration its diameter and, taking such interruptions of production into account, by calculating therefrom the actually produced yarn length. Since the bobbin diameter depends on the yarn thickness, the latter is determined from the diameter of the spun fiber sliver and from the drafting, i.e. from the ratio of sliver feeding speed and yarn draw-off speed. The bobbin diameter furthermore depends on how tightly the bobbin is being wound, i.e. on the winding tension, and for this reason the latter is also calculated from the ratios of winding speed and draw-off speed. The yarn thickness given as a reference value and the winding speed given as a reference value are now compared with the subsequent, actual, measured values.

A correction value is then formed from the resulting deviations and this correction value is taken into account when determining the actual bobbin diameter, leading to an increase or a decrease in the yarn length (by comparison to the reference yarn length) for the given bobbin diameter. It is obvious that the computer carrying out the appropriate correction was first programmed accordingly, when the reference values were entered, and that the corrections lead to correct result values. The correction values must be initially determined empirically and can then be entered in the same manner for all machines.

In order to eliminate imprecision, in particular in producing conical bobbins, a bobbin diameter determined as a function of a given circumference is used as a reference for conical bobbins.

It is possible that the pressure roller of the draw-off roller pair becomes run in after a long time of operation. This applies to an even greater extent to the winding roller which drives the bobbin. For this reason provisions can be made in another advantageous embodiment of the process according to the invention, for the actual yarn length corresponding to a given bobbin diameter to be checked at predetermined time intervals, so that the correction factor may be adjusted in case of deviations of the actual yarn length, while taking into consideration the correction factor of the theoretical yarn length to be expected. In this way wear that may have occurred in the meantime is taken into account, so that the bobbin size may be maintained constant within relatively narrow tolerance limits despite wear of drive elements affecting bobbin diameter.

Yarn length can be measured in principle with any bobbin diameter, this being especially practical when determining the reference values. When checking the bobbin diameter later, it is however generally sufficient to take the desired diameter of the full bobbin as the given bobbin diameter.

Since the twist of the yarn causes the yarn to become harder or softer, e.g. with rotor or friction spinning machines, provisions are made in another advantageous embodiment of the process according to the invention, for yarn twist to be taken into account, and for this purpose the twist of the yarn per unit of length is determined from the ratios of rotational speed of spinning element and draw-off speed, and deviations from a predetermined reference value are taken as a correction factor in determining the actual bobbin diameter. The predetermined reference value has in this case already been entered into the computer during programming, so that now a comparison with this known reference value is possible. The measuring of yarn twist can furthermore be used here to find the yarn thickness since, as stated before, the actual yarn thickness depends to a considerable extent on the twist in the yarn.

With spinning rotors, the RPM's of the spinning element are exactly equal to the number of twists produced in the yarn per unit of time. With friction spinning elements however, having a diameter which is a multiple of the diameter of a yarn and where its twist is produced by the rolling of the yarn against the circumferential surface of at least one friction spinning element, a much higher number of twist is produced in the yarn than the RPM's of the friction spinning element, and this must be taken into consideration in determining yarn twist per unit of length. The invention therefore provides for the determination of yarn twist per unit of length by taking into account the twist transmission ratio between spinning element and yarn in devices where twist is transmitted by the circumferential surface of the rotating spinning element to a yarn being formed and rolling on it.

In spinning processes where the yarn twist is produced by pneumatic means, yarn twist, and therefore the hardness of the yarn, depends on the force of the overpressure acting upon the yarn. This applies to a pneumatic open-end spinning process, in which individual fibers are incorporated into a rotating yarn end, as well as to a pneumatic false-twist spinning process, where a fiber sliver is drawn into a narrow fiber sliver, is given a false twist and is fixed in the false-twisted position by spread out fiber ends which are then again incorporated into the yarn.

For pneumatic spinning processes another advantageous embodiment of the object of the invention therefore provides for the overpressure taking effect in the spinning element and producing the yarn twist to be measured, and for the deviations from a predetermined reference value to be taken into account as a correction factor in determining the actual bobbin diameter.

The overpressure however does not take effect in direct proportion on the twist of the yarn and therefore also on the hardness and thickness of the yarn. The size of the bore feeding the compressed air to the spinning element, the position of this feed bore with respect to the central passage in the spinning element and its inclination with respect to the longitudinal axis of the spinning element cause the overpressure to take effect in the spinning element to a greater or lesser extent, so that the overpressure influences yarn thickness correspondingly to a greater or lesser extent. This varying influence intensity of the overpressure due to the different geometric variations of the spinning element is taken into account according to the invention, so that when a spinning element is replaced by one with a different geometry, the geometric deviations from a reference geometry of the spinning element is taken into account in determining the actual bobbin diameter. The magnitude of the correction factor is here first determined empirically and can be entered directly, without further tests, if necessary, by providing suitable markings at the input point of the correction factor or by taking the corresponding value in a table and entering it as a numerical value.

The characteristics of the fiber material being spun constitute another factor which may affect the bobbin diameter. Thus natural fibers are as a rule much more elastic and full than synthetic fibers. Here too, a reference value is formed as the computer is fed its data. In addition, the invention provides for fiber material characteristics affecting the bobbin diameter to be taken into consideration as a correction factor in determining the actual bobbin diameter later, in course of production.

The determination of the bobbin diameter at a given moment is important for a number of different reasons. A signal to initiate bobbin replacement is for example emitted advantageously when a predetermined bobbin diameter, ascertained while taking the correction factors into account, has been reached. On the other hand the determination of the bobbin diameter is also very important in connection with the repair of yarn breakage. According to the invention, the ascertained bobbin diameter is transmitted to the drive of a yarn take-up device as a characteristic signal magnitude to determine a setting value in connection with the repair of a yarn breakage, and the yarn take-up device is placed at a defined distance from the circumference of the bobbin in process of formation.

Wear phenomena can also occur in the yarn take-up device and in its drive, affecting adjustment precision at the different spinning stations, and thereby also affecting the reliability of yarn take-up. The invention therefore provides that such play occurring at individual spinning stations and affecting the distance between the yarn take-up device and the circumference of the bobbin be taken into consideration as a correction factor.

Such play can in time change as a result of wear, and thereby lead to a change in the precision of presentation of the yarn take-up device in relation to the bobbin. In order to compensate for such changes in play, provisions are made in an advantageous further development of the process of the invention, for the play occurring at the individual spinning stations and affecting the distance between the yarn take-up device and the circumference to be checked at predetermined time intervals and for the corresponding correction factor to be adjusted in case of change in this play.

To carry out the process according to the invention, a rotational speed recording device is assigned to each of the sliver feed device, the draw-off device and the winding device to ascertain their RPM's. The rotational speed recording devices are connected to a common control device into which the yarn length corresponding to a given bobbin diameter can be entered and which can be corrected in the form of correction factors which have been calculated based on the found RPM's of sliver feed device, draw-off device and winding device.

To be able to take into account the yarn twist when determining the bobbin diameter at that moment, a measuring element is assigned or can be presented to the spinning element or to its drive when the spinning element rotates for yarn production. The measuring element is connected to the control device to produce a correction factor.

It is not necessary for this invention that the spinning element rotate. The invention can also be applied when the spinning element is of a non-rotating nature and an air eddy revolves within it and is kept revolving by the arrival of compressed air at a tangent to produce the yarn. This may be an open-end spinning element or only a spinning element in which a narrow fiber sliver is imparted false twist to produce a yarn. The invention provides in that case that the control element be equipped with at least one compressed-air delivery opening letting out laterally in a yarn forming zone from which the forming yarn is drawn off axially and that a signal generator ascertaining the degree of overpressure be assigned to a compressed air circuit letting out in said compressed-air delivery opening or to a compressed-air source producing the compressed air, the signal generator being connected to the control device for the production of a correction factor.

The control device is preferably connected for control to a bobbin replacement device, so that when a predetermined bobbin size is reached, the replacement of a full bobbin by an empty tube can be initiated.

It is furthermore advantageous for the control device to be connected for control to a drive of a yarn take-up device by means of which the latter is positioned at a defined distance from the circumference of the bobbin which is being built up at that moment. Since the greatest variety of correction values can be entered into the control device (in addition to the reference values) the yarn take-up device can thus always be brought into an optimal position with respect to the bobbin being formed in order to take up the yarn end needed for piecing.

Since not all correction factors can be measured automatically but must be in part found empirically, such as changing tolerances for example, the invention appropriately provides for an input device to be assigned to the control device for the manual entry of correction factors. The input device is in this case preferably broken down into several input elements, one of which is used to enter fiber material characteristics affecting the bobbin diameter and another to enter a play at the spinning station in question which affects the presentation of the yarn take-up device to the bobbin.

So that not each spinning station need not be assigned its own input devices, another advantageous embodiment of the invention provides for each control device per spinning station to have its own separate memory to which the input devices can be selectively assigned.

According to the instant invention, a "correction factor" is any value which changes the values entered into the control device as basic setting. It does not matter here whether the theoretical yarn length, play that may be present somewhere, wear in conveying or transmission elements etc. are taken into consideration.

The bobbin diameter is needed as a characteristic signal magnitude for control, as well as for timely bobbin replacement, and to control a yarn take-up device. The technical situation until determination of bobbin diameter, i.e. until obtention of a corresponding signal magnitude which is finally used as an input magnitude to control the above-mentioned processes, is described.

As indicated earlier, the process and the device according to the invention make it possible to determine precisely the present bobbin diameter in a simple and sure method, without contact and in adaptation to all possible variables, including varying degrees of wear, this being of considerable importance for different tasks in the course of the spinning process. In this manner bobbin replacement can be effected precisely at the right moment. Furthermore, the yarn length needed for piecing when conical bobbins are used can be determined with greater precision when the bobbin size is known. In addition, it is essential for precise yarn take-up from the bobbin that the size of the bobbin be known so that the yarn take-up nozzle may be adjusted precisely in relation to the bobbin for take-up, so that the yarn take-up nozzle may be brought as close as possible to the surface of the bobbin without danger of damaging the bobbin.

The solution according to the invention can be applied with open-end spinning devices imparting twist to the fiber slivers by mechanical means as well as with those imparting twist to fiber slivers by pneumatic means. It is not even necessary for the spinning device to operate according to the open-end spinning principle, such as rotor spinning, friction spinning or electrostatic spinning devices, but the invention can also be used with false-twist spinning where twist is imparted by pneumatic means.

The object of the invention can be realized in an economic manner since all the driven elements have as a rule one central drive to which the rotational-speed measuring devices can be assigned. Therefore it is possible to incorporate the object of the invention later at low cost into already existing machines with a plurality of identical work stations.

Embodiments of the invention are shown in the drawings which are incorporated in and constitute a part of this specification.

DETAILED DESCRIPTION OF THE PREFERRED EMBODIMENTS

Figure 1:
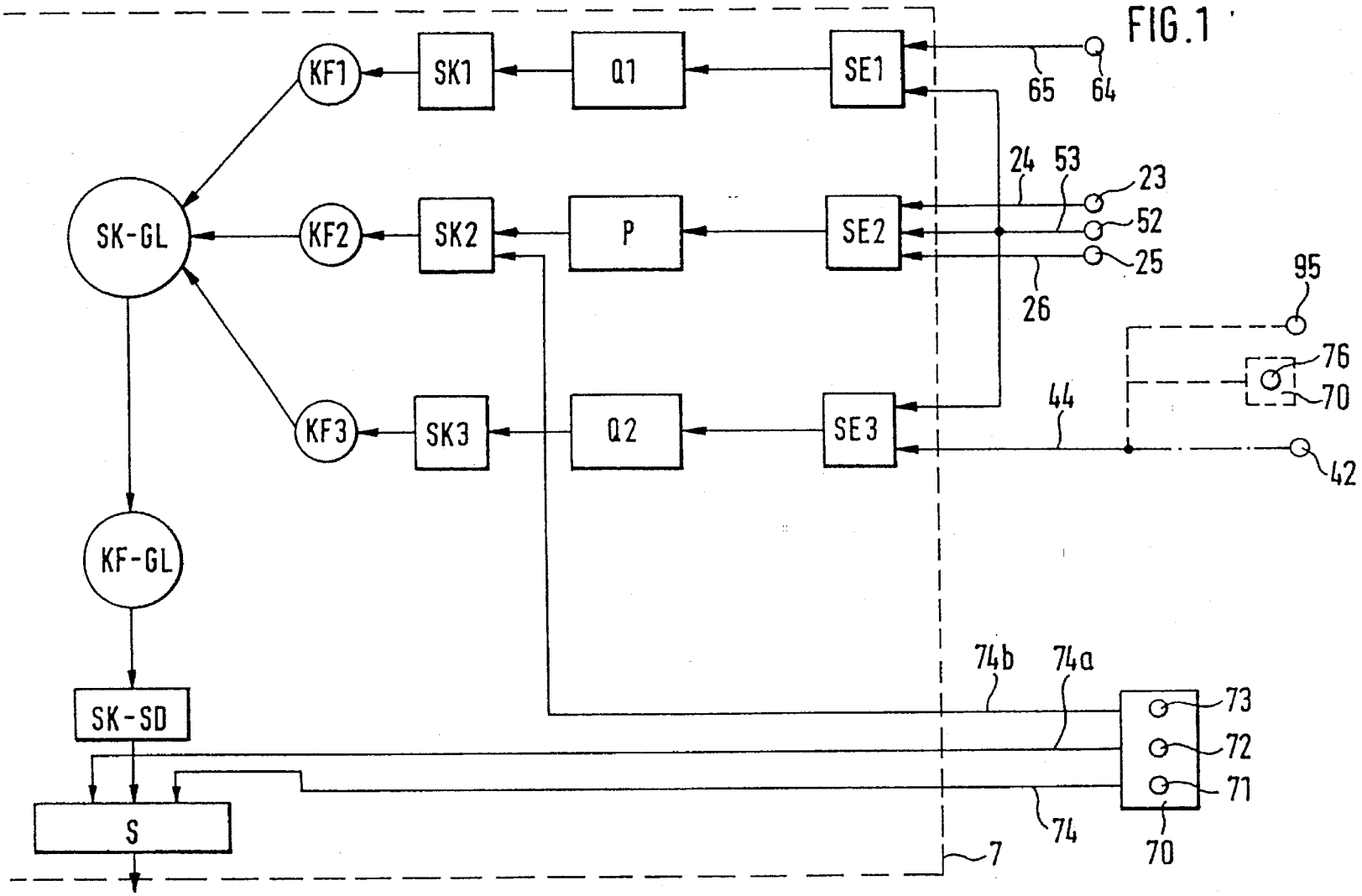
FIG. 1 shows the course of signal detection and processing according to the invention for the determination of bobbin diameter with rotor spinning or spinning with pneumatic imparting of twist.

Reference will now be made in detail to the presently preferred embodiments of the invention. Each example is provided by way of explanation of the invention, not limitation of the invention. In fact, it will be apparent to those skilled in the art that various modifications and variations can be made in the present invention without departing from the scope or spirit of the invention. The numbering of components in the drawings is consistent throughout the application, with the same components having the same number in each of the drawings.

Since the rotor spinning machine in particular has found acceptance in practical applications, a first embodiment of the invention will be explained here with the help of an open-end spinning machine in the form of a rotor spinning machine.

Figure 2:
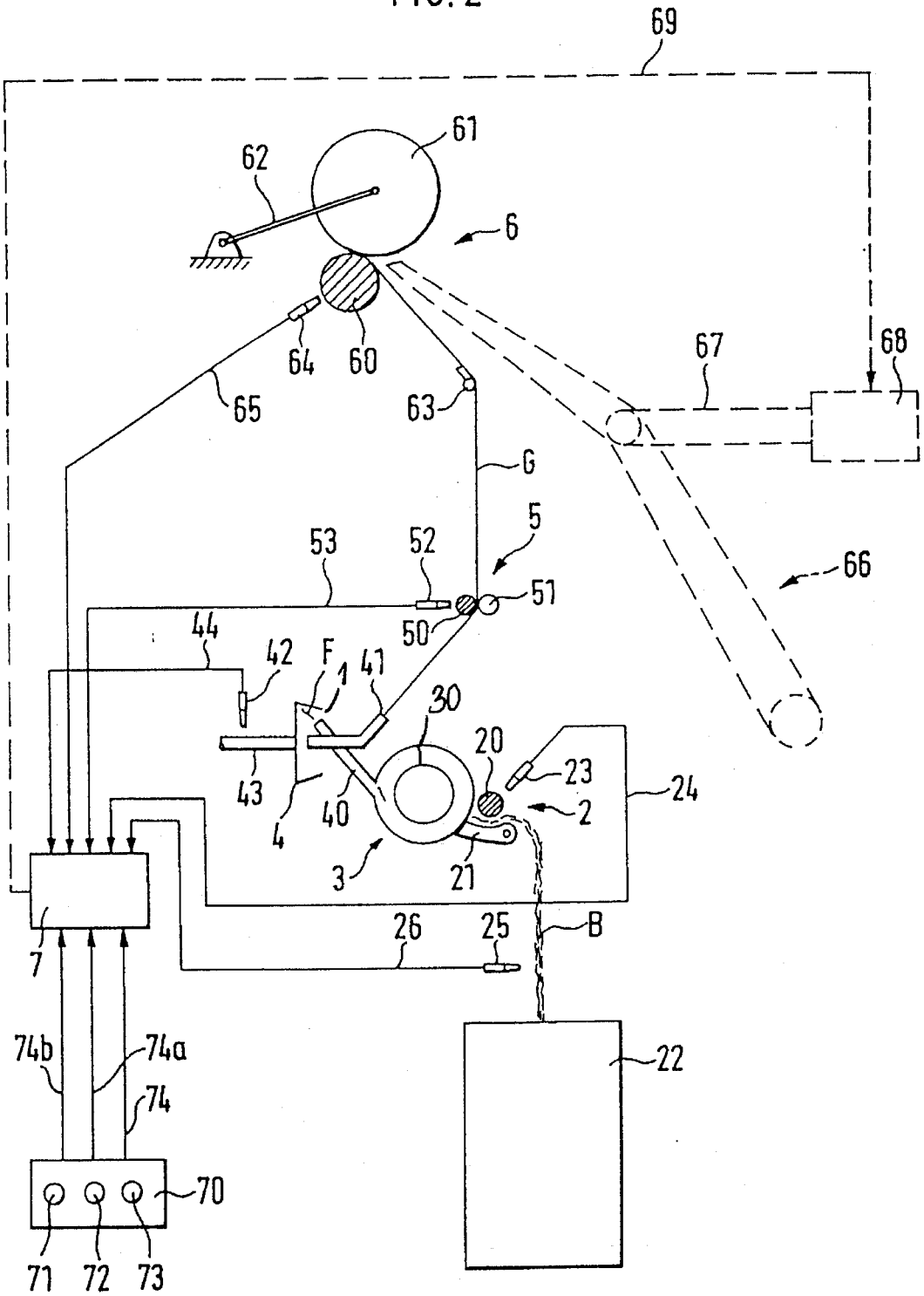
FIG. 2 shows a schematic cross-section through a spinning station of a rotor spinning machine designed according to the invention.

FIG. 2 shows a cross-section through a work or spinning station of such a rotor spinning machine with only those essential elements which are absolutely necessary to understand the invention; the other elements required for spinning or piecing are not shown, for the sake of clarity of the drawing.

The spinning device 1 of the rotor spinning machine is provided with a feeding device 2, an opener device 3 and a spinning element in form of a spinning rotor 4. The spinning device 1 is followed by a draw-off device 5 and a winding device 6.

The feeding device 2 is provided with a driven feed roller 20 and a feed trough 21 interacting with same. A fiber sliver B deposited in a can 22 is fed to it. The feed roller 20, which extends normally over a plurality of spinning stations, is assigned a sensor 23 at a suitable location, e.g. in the drive frame of the machine, to ascertain the RPM's of the feed roller 20.

The opener device 3 is provided with an opener roller 30 located in a housing 31, from which a fiber feeding channel 40 extends into the spinning rotor 4 in order to feed the fibers F which are combed out from the leading end of fiber sliver B which is being fed to the opener roller 30 by the feeding device 2 to the spinning rotor 4, where they are incorporated into the end of a yarn G.

Yarn G leaves the spinning rotor 4 located in a housing (not shown) through a yarn draw-off pipe 41, and is continuously drawn off by draw-off device 5 from the spinning rotor 4 for that purpose. The draw-off device 5 consists in a conventional manner of a driven draw-off roller 50 extending over a plurality of spinning stations and of one pressure roller 51 per spinning station.

Yarn G is fed by draw-off device 5 to the winding device 6 which is equipped with a winding roller 60 extending over a plurality of spinning stations on which one forming bobbin 61 per spinning station rests and is held rotatably between two swivelling arms 62. The winding device 6 is equipped with a traversing yarn guide 63 for the traversing winding of yarn G.

As is the case for the feeding device 2, the spinning rotor 4, the draw-off device 5 and the winding device 6 are also each assigned a sensor 42, 52 or 64. Sensor 42 scans the spinning rotor 4 itself or its shaft 43 or its drive (e.g. supporting disks, not shown here, which rotate at a fixed speed ratio to the spinning rotor 4). The sensors 52 or 64 scan the draw-off roller 50 or the winding roller 60 extending over a plurality of spinning stations and are located at a suitable location, e.g. just as the sensor 23, in the drive end frame of the machine.

The sensors 23, 42, 52 and 64 are connected via circuits 24, 44, 52 and 65 to a control device 7 which controls different processes, such as the replacement of a full bobbin 61 by an empty tube or a piecing processes after a machine stoppage or a yarn breakage.

An input device 70 with several setting devices 71, 73 and 73 whose functions will be described below in greater detail is connected to the control device 7 via circuit 74.

At the described open-end spinning machine four different rotational speeds are thus detected by conventional sensors 22, 42, 52 and 64. These are:

The rotational speed of the feed roller 20 (sensor 23);

The rotational speed of the rotor (sensor 42);

The rotational speed of the draw-off roller 50 (sensor 52);

The rotational speed of the winding roller 60 (sensor 64).

In addition the sliver thickness of the incoming fiber sliver B is determined via sensor 25. Sensor 25 is connected to the control device 7 via circuit 26.

Several constants which influence the bobbin size are entered manually into the input device 70 by means of a keyboard or rotatable setting knobs (input devices 71 to 74). The material constants which influence yarn thickness are among these constants. These material constants result from the variations in the material to be processed, e.g. elasticity and thickness of the cotton or synthetic fibers. The signals arriving through sensors 23, 25, 42, 52 and 64 are detected and transmitted for further processing together with this signal detection.

Three basic processing planes in combination with each other lead to the determination of yarn length.

In a first plane the signal detection SE2 (FIG. 1) detects the number of the fed fiber sliver B (sensor 25), the rotational speed of the feed roller 20 (sensor 23) and the rotational speed of the draw-off roller 50 (sensor 52).

The yarn thickness can be calculated as a product P from the number of the fiber sliver B and the ratios of feed roller speed and speed of the draw-off roller 50. Characteristics of different materials (such as fiber thickness, among others) which influence the yarn thickness are known material parameters which are also taken into consideration as signal magnitudes in the formation of signals for yarn thickness. These material parameters are entered manually into input device 70 by means of a keyboard or other setting device 71, and for this purpose each memory per spinning station has a separate memory to which the input device 70 can be selectively assigned. A numbers keyboard is, for instance, provided for this, by means of which the desired spinning station can be selected.

The rotational speed of the draw-off roller 50 (sensor 52) and the rotational speed of the winding roller 60 (sensor 64) constitute the basis for the calculation of the winding tension which represents a measure of the winding hardness of bobbin 61. The signals obtained through signal detection SE1 are processed into a quotient Q1 of the speed of winding roller 60 and the speed of draw-off roller 50. The signal parameter SK1 of this ratio constitutes the winding tension.

The detection of the rotor speed (sensor 42) and of the rotational speed of the draw-off roller 50 (sensor 52) in signal detection SE3 constitutes the basis for the determination of yarn twist. A signal magnitude SK3 representing yarn twist is calculated through the formation of ratio Q2 of rotor speed and speed of the draw-off roller 50.

When the open-end spinning machine is first put into operation, the signal magnitudes for yarn thickness SK2, winding tension SK1 and yarn twist SK3 are ascertained. In order to further minimize the influence factors upon these signals, appropriate correction values are calculated. The correction values result from a reference process by which the yarn thickness, winding tension and yarn twist found at any later point in time are compared with those magnitudes which formed the basis of conditions at first start-up for the given bobbin diameter, and by which deviations are used for the yarn length in finding the actual bobbin diameter. The correction values for winding tension KF1, yarn thickness KF2 and yarn twist KF3 obtained in the reference process are combined in order to determine the yarn length SK-GL. The yarn length produced must be determined while taking into account possible production stoppages at a spinning station.

The signal magnitude SK-GL for yarn length is checked in the reference process with respect to the constitution of a correction factor. As a correction factor for yarn length KF-GL is constituted, it is taken into account in the subsequent determination of bobbin diameter.

The bobbin diameter which can be corrected in this manner is used as a signal magnitude SK-SD for control S of timely bobbin replacement or for control S of a yarn take-up device 66 (FIG. 2) in relation to the bobbin surface, whereby the desired bobbin size is entered for bobbin replacement by the setting device 73 via circuit 73.

A yarn take-up device 66 of this type is shown by broken lines in FIG. 2 and is normally made in the form of a suction nozzle installed on a service unit travelling alongside the spinning machine. The suction nozzle is mounted so as to be able to swivel and can be swivelled from a rest position, in which it is swivelled away from bobbin 61, into an operating position in which its outlet is located at a predetermined distance from the circumference of bobbin 61 in order to aspire the yarn end on bobbin 61 following a yarn breakage while the bobbin 61 is at the same time rotating backwards. If the distance is too great, the suction force acting on the bobbin surface is too weak to take up yarn G. If on the other hand the distance is too small, the outlet of the suction nozzle bumps at least in part against the layers of bobbin 61, creating a danger that these layers or the wound-up yarn G may be damaged. The suction nozzle of the yarn take-up device 66 is connected via a coupling housing 67 to a drive 68 which is able to bring the suction nozzle into a defined position in relation to bobbin 61. For example, a stop and a sliding coupling (not shown) are assigned to the drive 68, whereby the stop is adjusted by the control device 7 via a circuit 69 in function of the bobbin size at that moment. The suction nozzle is for this purpose mounted movably at its end towards the suction air source and can be moved via a pivotable intermediate pipe segment.

If play is found through periodically conducted tests in the constant distance to the bobbin surface when positioning the yarn take-up device 66, this play can be corrected directly in relation to controls in the positioning at a distance by manual input of a correction value via the keyboard (setting device 72, circuit 74*a*).

The process and/or the device can be varied in many ways within the framework of the invention, e.g. by replacing individual characteristics by equivalents or through other combinations. Thus it is possible, for example, to distribute the setting devices 71, 72 and 73 among different input devices 70 which are located at different locations and/or are different in design from each other. It is also possible to use input devices for the input of numbers subject to digital selection or in form of rotating knobs for the input of analog values.

As stated earlier, the invention is not limited to spinning machines with mechanical imparting of twist. It can be applied to all spinning machines in which a fiber sliver B is spun into a yarn G. One such spinning machine is also a wrapping-spinning machine on which a core yarn is produced around which a wrapping yarn is wrapped. It is obvious that in this case the thickness of the wrapping yarn, the number of windings per unit of lengths as well as the tension with which the wrapping yarn is wound around the core yarn must be taken into consideration. Appropriate sensors and/or setting devices must be provided for this.

When the spinning element, e.g. a spinning rotor 4, is imparted twist which it then transmits to the yarn G being produced, the twist of the yarn can be easily and directly derived from the number of rotations of the spinning element. In a spinning rotor 4 the number of twists is indicated directly by the rotor RPM's. In a friction spinning element the ratio between the diameter of the driven friction spinning element and of the yarn G must be taken into consideration in calculating the yarn twist. In such case the diameter ratio in question must also be taken into consideration when calculating the ratio of RPM's of the spinning element and the draw-off speed. In other words, this means that as the twist is transmitted from the circumference of the spinning element to the yarn which rolls against it and is in the process of formation, the twist transmission ratio must be taken into consideration in order to determine the twists of the yarn per unit of length.

Figure 3:
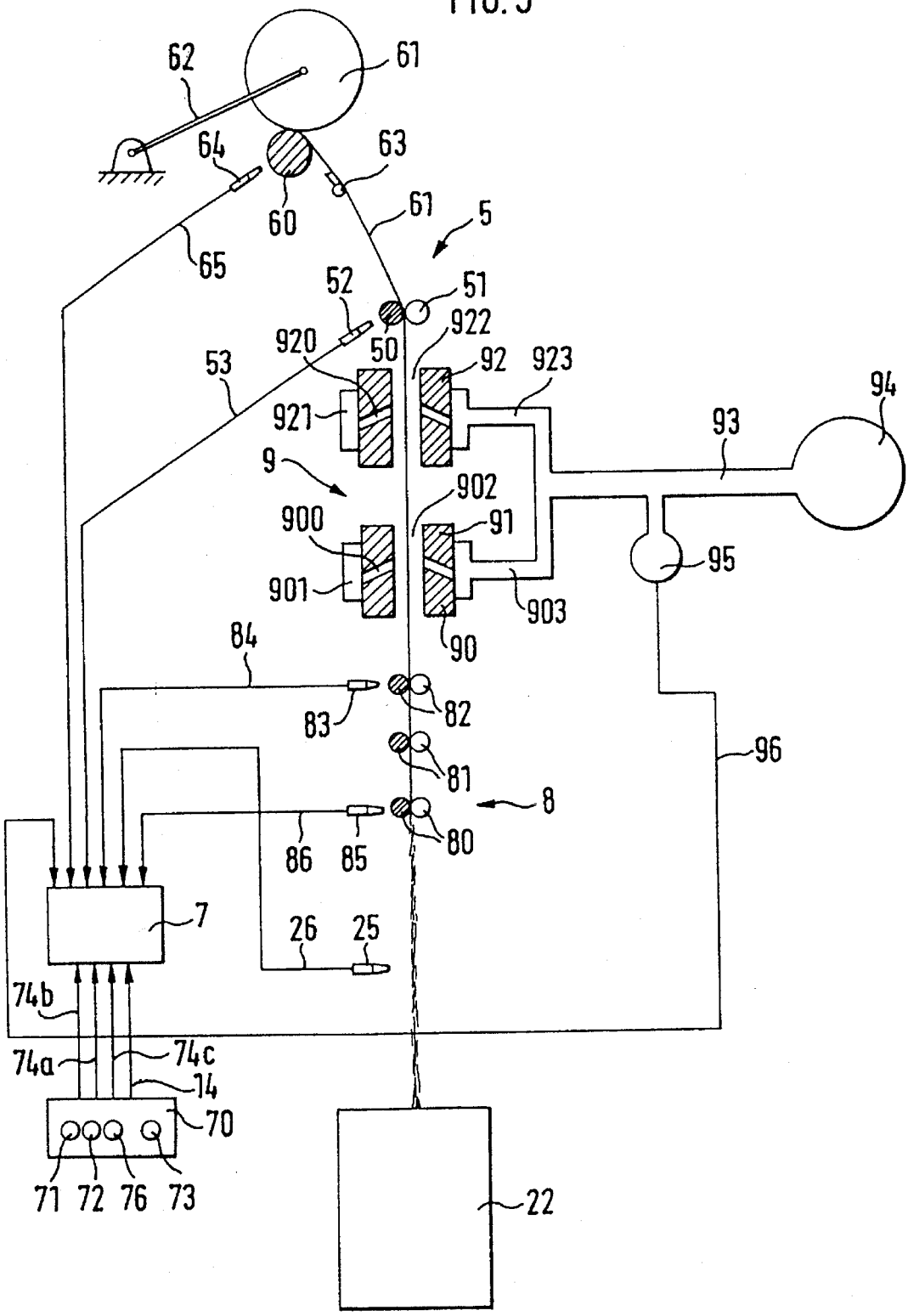
FIG. 3 shows a schematic cross-section with partial top view through a spinning station designed according to the invention of a false-twist spinning machine.

As mentioned earlier, the process can also be used with spinning machines in which the yarn is imparted its twist by pneumatic means. Such a spinning device is shown in FIG. 3. The feed device 8 is in this case a draw frame which draws the fed fiber sliver B into a narrow fiber sliver by means of its roller pairs 80, 81 and 82, the narrow fiber sliver being spun into a yarn G in spinning element 9.

The spinning element 9 in the embodiment shown consists of a first nozzle, an injector nozzle 90 and a downstream twisting nozzle 92 leaving a gap 91. The injector nozzle 90 and the twisting nozzle 92 each are provided with compressed-air feeding openings 900 or 920 which start out from a ring channel 901 or 921 surrounding the injection nozzle 90 or the twisting nozzle 92 and let out essentially at a tangent with axial component into the axial bore 902 or 922 of the injection nozzle 90 or the twisting nozzle 92. The two ring channels 901 and 921 stand one above the other.

Circuits 903 and 923 are connected to a common circuit 93 and through same to a common overpressure source 94. A manometer 95 is connected to circuit 93 and is connected for control via a circuit 96 to the control device 7.

In addition, two sensors 83 and 85 are connected via circuits 84 and 86 to the control device 7 each scanning a roller of the roller pair 82 or 80 located at the input of the draw frame. In addition, sensors 25, 52 and 64 are connected via circuits 26, 53 and 65 and scan the fiber sliver B, the draw-off roller 50 and the winding roller 60, as explained with the embodiment of FIG. 2.

Furthermore an input device 70 is connected for control via circuits 74, 74*a*, 74*b*, 74*c* to the control device 7, which a setting device 71 (circuit 74*b*) to set processed material, a setting device 72 (circuit 74*a*) to set a correction factor for the wear influencing the mechanical parts of the yarn take-up device 66 (see FIG. 2), a setting device 73 (circuit 74) to set the desired bobbin diameter of a full bobbin 61 and a setting device 76 (circuit 74*c*) to set a correction factor to take into account the geometry of the spinning element 9 consisting of the injector nozzle 90 and the twisting nozzle 92.

The manometer 95 measures the overpressure prevailing in circuit 93 and therefore takes effect in the compressed-air feed opening 900 or 920 which lets out laterally into the yarn forming zone. The yarn forming zone is constituted in the described device by the two axial bores 902 and 922 of the injector nozzle 90 and of the twisting nozzle 92. The manometer 95 thus ascertains the overpressure acting upon the spinning element 9 and sends a corresponding signal to the control device 7. This signal generator (manometer 95) ascertaining the level of effective overpressure can be assigned directly to circuit 93 (as shown) or to the overpressure source 94.

To find the actual bobbin diameter, signals (in addition to signals coming from the sensors 25, 85, 83, 52 and 64) are constantly transmitted by the manometer 95 to the control device 7 and are compared with a value recorded in control device 7 as a reference value. If the signal coming from the manometer 95 deviates from the set value, a corresponding correction factor is constituted to correct the value for the bobbin diameter.

The drafting level of the fiber sliver B which can be corrected by the signal coming from sensor 52 is calculated from the signals coming from sensors 85 and 83.

The reference values for the setting of which only the setting device 73 in input device 70 is shown, are all set in the input device 70 by means of additional setting devices, whereby input device 70 or part thereof may be an integral part of the control device 7.

When the spinning element 9 is replaced, either completely or merely the injector nozzle 90 or the twisting nozzle 92, with a spinning element having a different geometry with respect to dimensions and/or arrangement or orientation of the compressed-air feeding openings 900 and/or 920, the effect of the compressed air upon yarn G changes naturally also, and a different imparting of twist results. This must be taken into account in calculating the size of the bobbin since yarn hardness and therefore also yarn cross-section are changed thereby.

This influence is determined by tests for each spinning element 9 that may be considered and recorded in the form of a correction factor which can either be stored in the control device 7 to be called up later by means of the setting device 76, or is entered in a table from which it may be taken when needed to be entered in the entering device 80 (setting device 76).

With conical bobbins 61 the value of a given generating line is used as the reference value. In principle any desired generating line can be used for this, but it has been shown to be advantageous, in case of bobbins 61 which are driven via their outer circumference, to use the diameter of the longitudinal zone where driving is carried out as reference.

Since the rollers conveying the fiber material or the rollers which drive them are subject to wear, differences between the desired value of the bobbin diameter and the actual bobbin diameter occur in time. In order to keep these differences within acceptable limits, tests are conducted periodically, optimally at predetermined time intervals, to find out whether differences occur and how great they are. If necessary, a correction factor must be entered by means of a setting device (not shown) of the input device 70.

In principle, any desired bobbin diameter is suitable to determine the desired values. However, since scattering is lower when a greater yarn length is selected, it is especially advantageous to use the full bobbin 61 in order to determine the yarn size assigned to a given yarn length.

I claim:

1. A process for acting upon and determining the diameter of a bobbin of wound yarn formed at a spinning station of a spinning machine, comprising the steps of:

feeding a fiber sliver of known thickness at a given speed to a spinning element at the spinning station for being spun into yarn, drawing off the spun yarn at a given draw-off speed, and winding the yarn onto a bobbin at a winding speed synchronized with the draw-off speed;

empirically determining a yarn length corresponding to a given bobbin diameter for predetermined conditions of yarn thickness and winding tension of the spinning station;

determining actual sliver thickness, sliver feeding speed, and yarn draw-off speed and calculating yarn thickness from the product of sliver thickness and the ratio of sliver feeding speed and yarn draw-off speed;

determining winding speed and calculating winding tension from the ratio of winding speed and yarn draw-off speed;

comparing the calculated winding tension and yarn thickness with the predetermined yarn thickness and winding tension used to empirically determine the yarn length corresponding to a given bobbin diameter and computing a correction factor based upon any differences therebetween, and with the correction factor computing actual yarn length and corresponding actual bobbin diameter conveying the actual bobbin diameter to a travelling service unit; and after receipt of the actual bobbin diameter, performing one of bobbin replacement and yarn piecing at the spinning station with the travelling service unit.

2. The process as in claim 1, further comprising entering the effect of interruptions of yarn production into the determination of actual yarn length.

3. The process as in claim 1, wherein said process is used to determine the bobbin diameter of a conical bobbin, said process including determining bobbin diameter at a predetermined reference generating line about said conical bobbin.

4. The process as in claim 1, further comprising measuring actual yarn length produced for given bobbin diameters at predetermined time intervals and computing a correction factor to compensate for any deviation between actual yarn length and computed yarn length due to wear of drive components of the spinning station.

5. The process as in claim 1, including selecting a desired diameter for a fully wound bobbin as the given diameter for which yarn length is empirically determined.

6. The process as in claim 1, wherein said determining actual yarn thickness includes determining the twist of the yarn produced per unit of length from a ratio of rotational speed of the spinning element and draw-off speed and comparing the ratio to a predetermined reference ratio and entering any deviation therebetween as a correction factor for yarn thickness.

7. The process as in claim 6, including transmitting twist from the circumference of a rotating spinning element to yarn rolling against it during the formation thereof.

8. The process as in claim 1, including imparting twist to the yarn through a pneumatic twisting device and wherein said determining actual yarn thickness includes determining the twist of the yarn produced per unit length, said process including measuring the overpressure in the pneumatic twisting device and comparing the measured overpressure to a reference overpressure value with any deviation therebetween being entered as a correction factor for yarn thickness.

9. The process as in claim 8, further comprising determining a correction factor for yarn thickness based on geometric differences between the actual pneumatic twisting device and a reference pneumatic twisting device used to determine the reference overpressure.

10. The process as in claim 1, further comprising determining a correction factor for determining actual yarn length based upon fiber material characteristics affecting bobbin diameter.

11. The process as in claim 1, further comprising initiating a bobbin replacement signal once a predetermined bobbin diameter has been reached as determined by said process.

12. The process as in claim 1, further comprising transmitting the bobbin diameter determined by said process to the drive of a yarn take-up device on said traveling service unit for repair of a yarn breakage, said process further comprising using the bobbin diameter as a factor for placement of the yarn take-up device at a desired defined distance from the circumferential surface of the bobbin.

13. The process as in claim 12, further comprising determining any play between components of the spinning station affecting the distance between the yarn take-up device and the circumferential surface of the bobbin and computing a correction factor therefor.

14. The process as in claim 13, further comprising checking the play at predetermined time intervals and adjusting the corresponding correction factor based upon any change in the play.

15. A device for acting upon and determining the diameter of a bobbin at a spinning station of a spinning machine, the spinning station having a spinning element, a controlled sliver feeding device, a controlled yarn draw-off device, and a controlled winding device, said device comprising:

rotational speed detection devices operably configured to measure the rotational speed of the sliver feeding device, the yarn draw-off device, and the winding device;

a control system operably configured with said speed detection devices, said control system configured to compute correction factors relating to yarn thickness and winding tension by determining actual yarn thickness and winding tension from the rotational speed of the sliver feeding device, yarn draw-off device, winding device and known sliver thickness, and comparing actual yarn thickness and winding tension to empirically determined yarn thickness and winding tension derived from a known yarn length and known bobbin diameter, said control system applying said correction factors to determine actual yarn length and actual bobbin diameter; and a service unit in operable communication with said control system, said control system conveying actual bobbin diameter to said service unit, said service unit being configured to perform one of bobbin replacement and yarn piecing at said spinning station upon receipt of a signal from said control system indicating actual bobbin diameter.

16. The device as in claim 15, further comprising a rotational speed detection device operably configured with the spinning station spinning element and said control system, said control system using the parameter of spinning element rotational speed to determine a yarn twist correction factor relating to yarn thickness.

17. The device as in claim 15, wherein said spinning station includes a pneumatic twisting device, said device comprising a signal generator configured to measure the overpressure of said pneumatic twisting device and operably connected to said control system, said control system computing a yarn twist correction factor based upon the measured overpressure from said signal generator as compared to a known overpressure.

18. The device as in claim 15, wherein said spinning machine includes a yarn take-up device, said control system operably configured with said yarn take-up device to control placing said yarn take-up device at a desired distance from the surface of a bobbin formed at a spinning station based upon the bobbin diameter determined by said control system.

19. The device as in claim 15, wherein control system includes an input device for entering correction factors affecting yarn length and bobbin diameter.

20. The device as in claim 19, wherein said input device comprises input elements for entering at least fiber material characteristics and measured degree of play of spinning station components affecting placement of the yarn take-up device relative the bobbin.

21. The device as in claim 19, wherein said control system includes individual memories assigned to each spinning station, said input device being separately assignable to said individual memories for inputting correction factors relating to the individual spinning stations.

* * * * *